US010501952B1

(12) United States Patent
Greenwood

(10) Patent No.: US 10,501,952 B1
(45) Date of Patent: Dec. 10, 2019

(54) INFLATABLE POOL COVER ASSEMBLY

(71) Applicant: Beth Greenwood, Fiskeville, RI (US)

(72) Inventor: Beth Greenwood, Fiskeville, RI (US)

( * ) Notice: Subject to any disclaimer, the term of this patent is extended or adjusted under 35 U.S.C. 154(b) by 0 days.

(21) Appl. No.: 15/993,279

(22) Filed: May 30, 2018

(51) Int. Cl.
*E04H 4/10* (2006.01)
*E04H 4/08* (2006.01)

(52) U.S. Cl.
CPC ..... *E04H 4/103* (2013.01); *E04H 4/08* (2013.01)

(58) Field of Classification Search
CPC ..... E04H 4/103
USPC ..... 4/499
See application file for complete search history.

(56) References Cited

U.S. PATENT DOCUMENTS 4,109,325 A 8/1978 Shuff
4,825,479 A 5/1989 Bonneau
4,953,239 A 9/1990 Gadsby
5,144,704 A * 9/1992 Genzel ..... E04H 4/103 4/498
6,286,157 B1 9/2001 Baumann
D470,210 S 2/2003 Rodriguez
8,201,285 B1 * 6/2012 Pugliese ..... E04H 4/103 4/498
2007/0143915 A1 6/2007 Vangelist
2012/0246818 A1 10/2012 Dautrich
2015/0284970 A1 * 10/2015 Herd ..... E04H 4/103 4/499
2017/0367539 A1 * 12/2017 DeLau ..... E04H 4/103

* cited by examiner

*Primary Examiner* — Christine J Skubinna

(57) ABSTRACT

An inflatable pool cover assembly includes a top disk that is positionable in a pool and float on water in the pool. A bottom disk is positionable in the pool and float on the water in the pool. A bladder is positioned between the top disk and the bottom disk and the bladder is inflatable to a selected diameter. The bladder is inflated to engage an inside surface of a perimeter wall of the pool thereby covering the water in the pool. A plurality of engaging members is each coupled to the bladder and each of the engaging members releasably engages the perimeter wall of the pool. An inflation unit is coupled to the top disk and the inflation unit is in fluid communication with the bladder. A cartridge is provided that is filled with a compressed gas. The cartridge is fluidly coupled to the inflation unit thereby facilitating the compressed gas to exit the cartridge and inflate the bladder.

6 Claims, 5 Drawing Sheets

INFLATABLE POOL COVER ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to pool cover devices and more particularly pertains to a new pool cover device for covering a pool using a bladder inflated with compressed gas.

BRIEF SUMMARY OF THE INVENTION

An embodiment of the disclosure meets the needs presented above by generally comprising a top disk that is positionable in a pool and float on water in the pool. A bottom disk is positionable in the pool and float on the water in the pool. A bladder is positioned between the top disk and the bottom disk and the bladder is inflatable to a selected diameter. The bladder is inflated to engage an inside surface of a perimeter wall of the pool thereby covering the water in the pool. A plurality of engaging members is each coupled to the bladder and each of the engaging members releasably engages the perimeter wall of the pool. An inflation unit is coupled to the top disk and the inflation unit is in fluid communication with the bladder. A cartridge is provided that is filled with a compressed gas. The cartridge is fluidly coupled to the inflation unit thereby facilitating the compressed gas to exit the cartridge and inflate the bladder.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
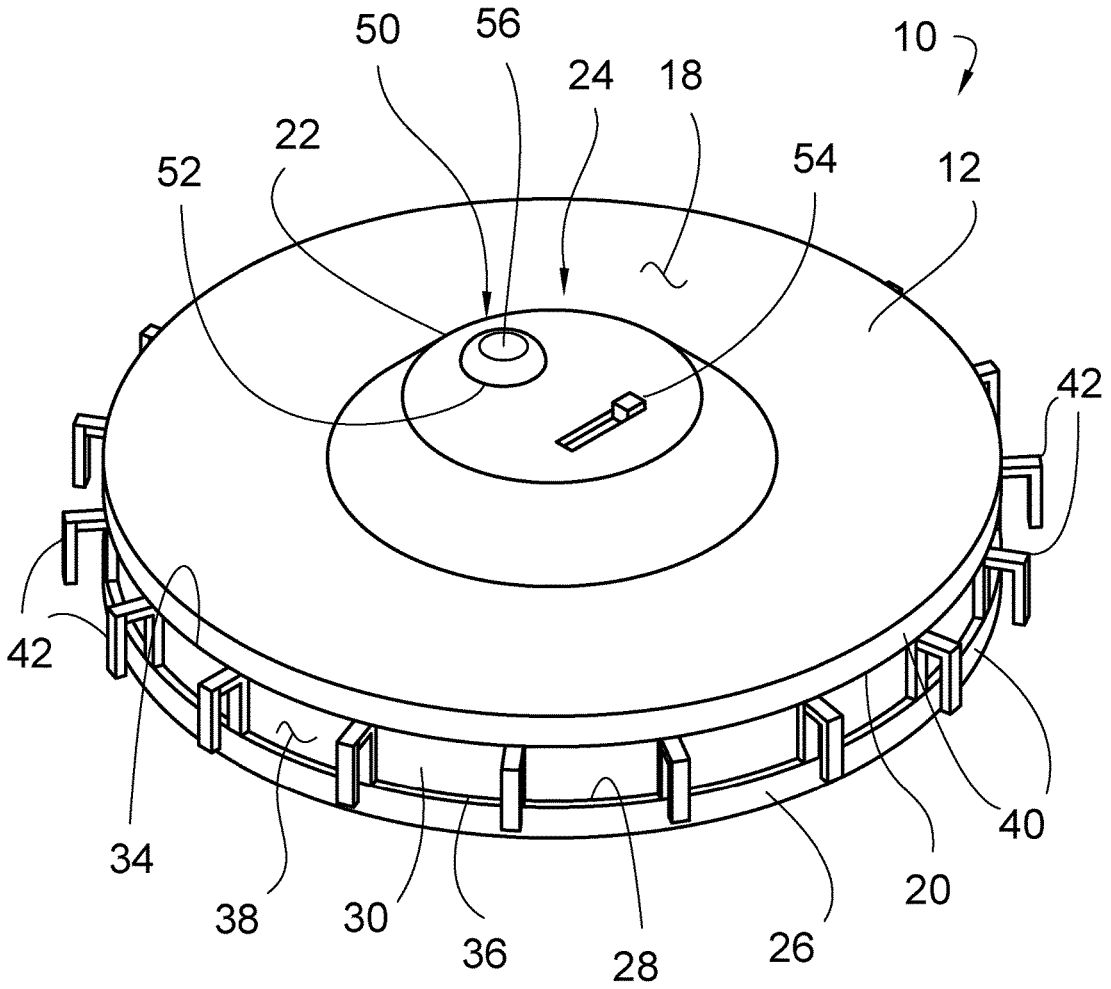
FIG. 1 is a top perspective view of an inflatable pool cover assembly according to an embodiment of the disclosure.
Figure 2:
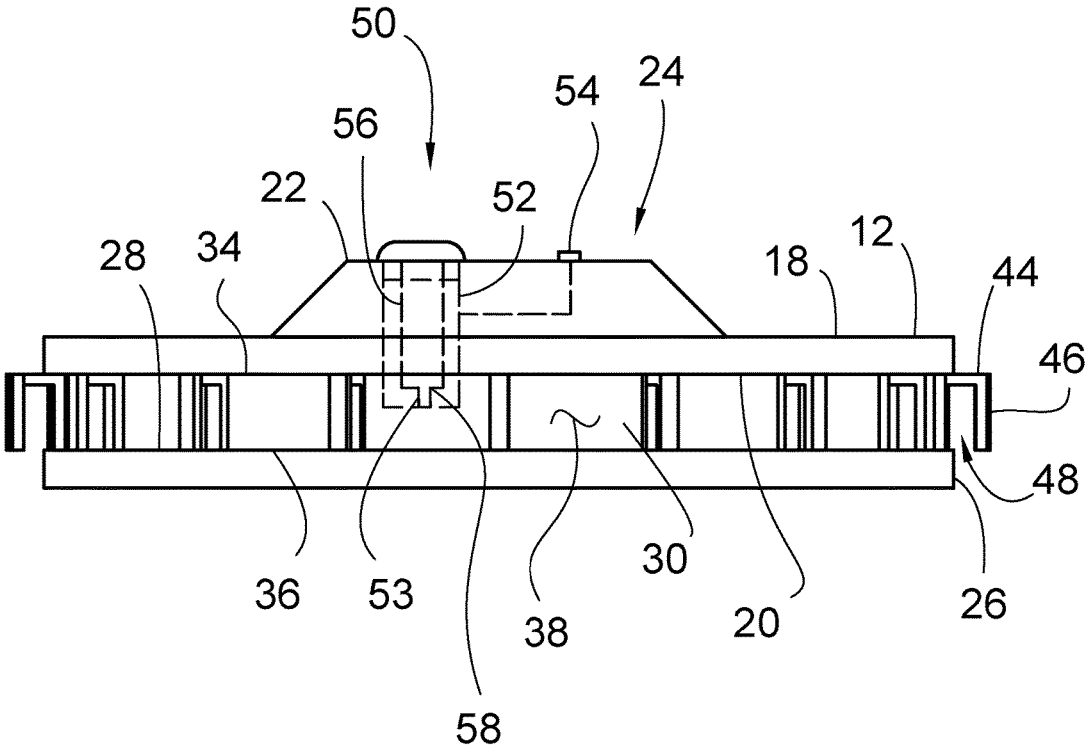
FIG. 2 is a front phantom view of an embodiment of the disclosure showing a bladder being deflated.
Figure 3:
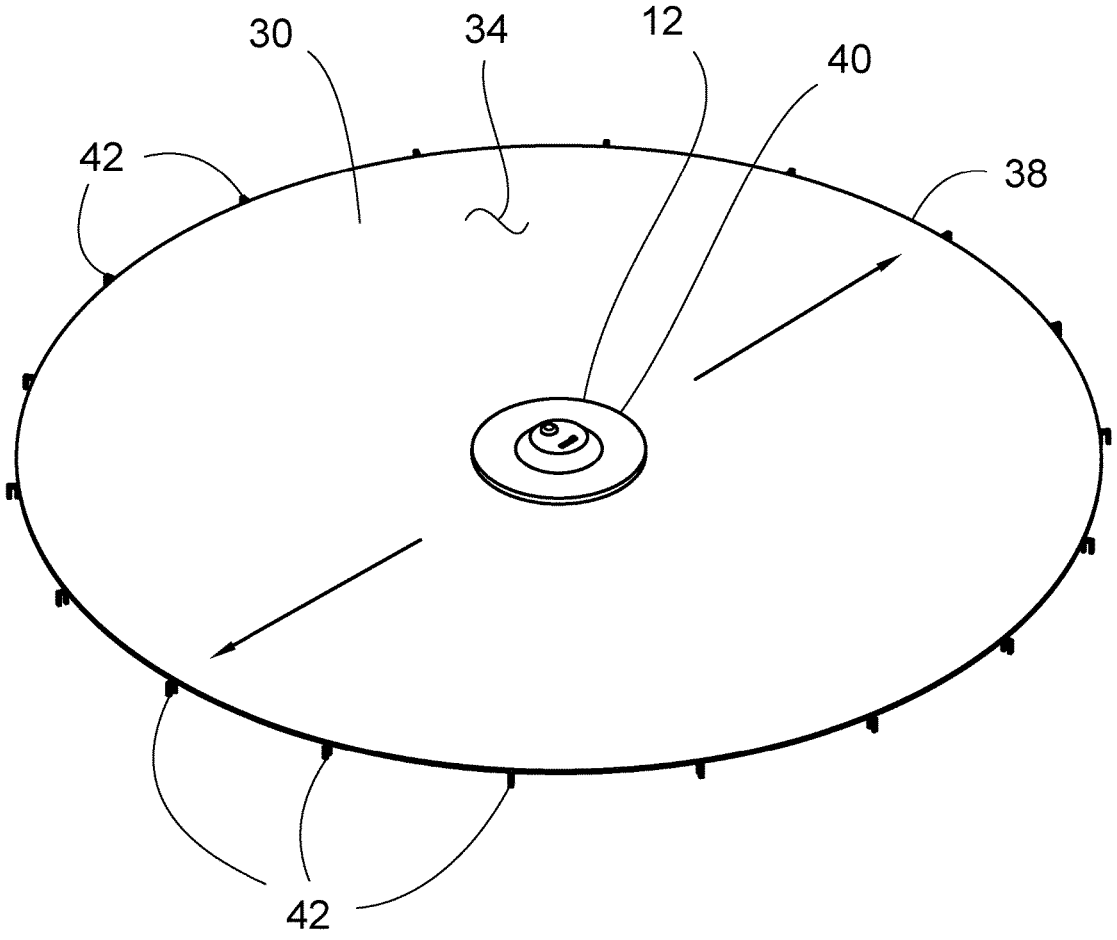
FIG. 3 is a top perspective view of an embodiment of the disclosure showing a bladder being inflated.
Figure 4:
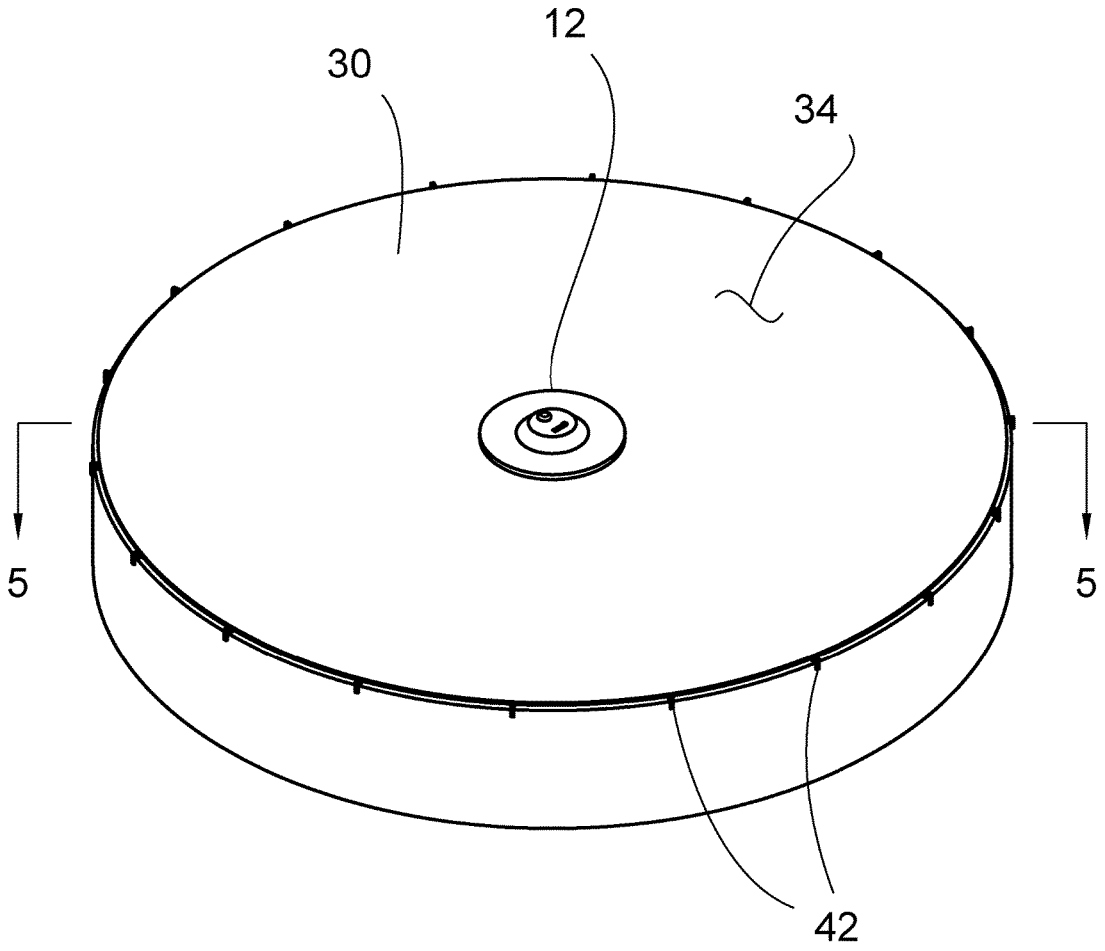
FIG. 4 is a perspective in-use view of an embodiment of the disclosure.
Figure 5:
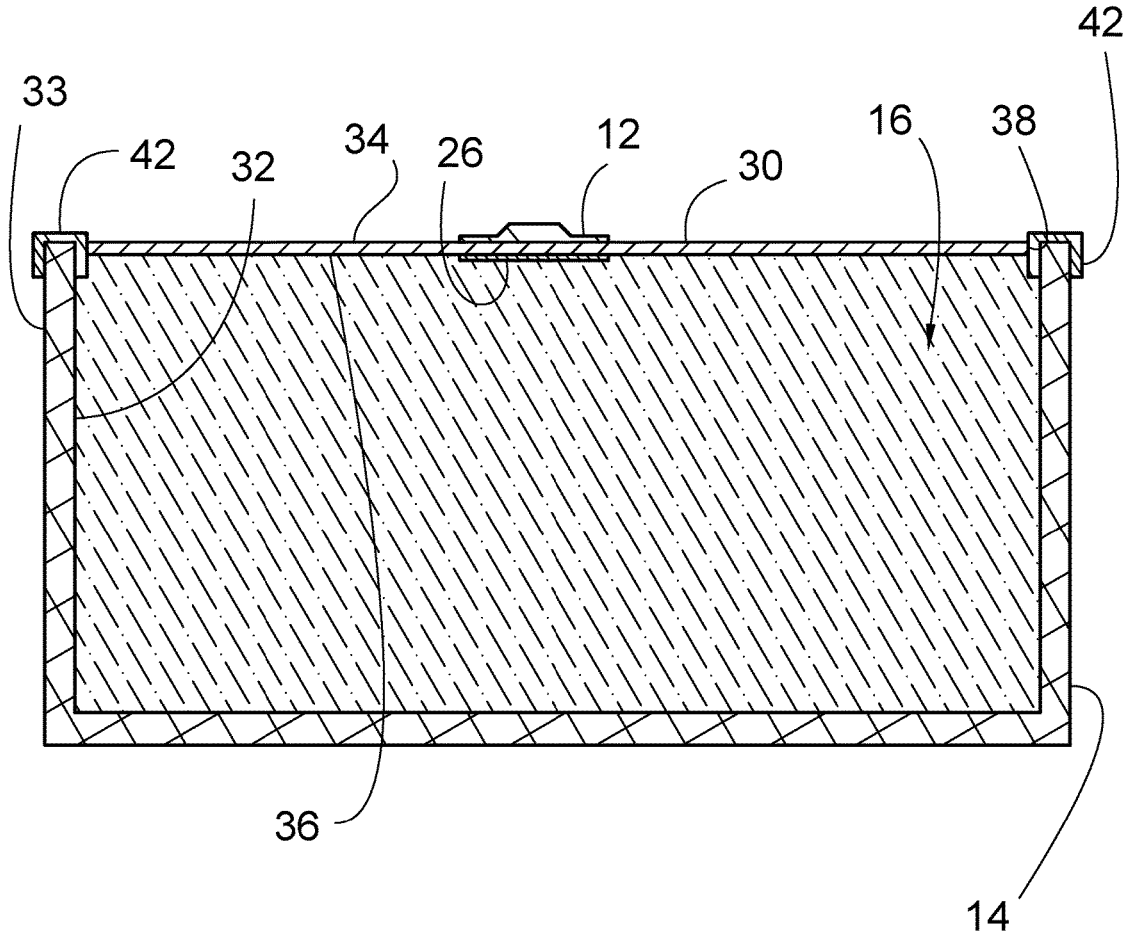
FIG. 5 is a cross sectional view taken along line 5-5 of FIG. 4 of an embodiment of the disclosure.

With reference now to the drawings, and in particular to FIGS. 1 through 5 thereof, a new pool cover device embodying the principles and concepts of an embodiment of the disclosure and generally designated by the reference numeral 10 will be described.

As best illustrated in FIGS. 1 through 5, the inflatable pool cover assembly 10 generally comprises a top disk 12 that is positionable in a pool 14. The top disk 12 is comprised of a buoyant material to float on water 16 in the pool 14. The top disk 12 has a top surface 18 and a bottom surface 20, and the top surface 18 has a prominence 22 extending away from the bottom surface 20 to define a housing 24 on the top disk 12. A bottom disk 26 is provided and the bottom disk 26 is positionable in the pool 14. The bottom disk 26 is comprised of a buoyant material to float on water 16 in the pool 14 and the bottom disk 26 has an upper surface 28.

A bladder 30 is positioned between the top disk 12 and the bottom disk 26 and the bladder 30 is comprised of resiliently stretchable material. Moreover, the bladder 30 is inflatable to a selected diameter such that the bladder 30 engages an inside surface 32 of a perimeter wall 33 of the pool 14. In this way the bladder 30 expands to cover the water 16 in the pool 14 in the convention of a pool cover. The bladder 30 has a top surface 34, a bottom surface 36 and an outer surface 38 extending therebetween, and the outer surface 38 is continuous such that the bladder 30 has a circular shape. Additionally, the bladder 30 may be manufactured with a variety of maximum diameters thereby facilitating the bladder 30 to cover a wide range of pool 14 sizes from the smallest pools to the largest pools.

The bottom surface 20 of the top disk 12 is coupled to the top surface 18 of the bladder 30 and the top disk 12 is centrally positioned on the top surface 18 of the bladder 30. The upper surface 28 of the bottom disk 26 is coupled to the bottom surface 20 of the bladder 30 and the bottom disk 26 is centrally positioned on the bottom surface 20 of the bladder 30. The outer surface 38 of the bladder 30 is spaced outwardly beyond a perimeter edge 40 of each of the top disk 12 and the bottom disk 26 when the bladder 30 is inflated. In this way the outer surface 38 abuts the inside surface 32 of the perimeter wall 33 of the pool 14. Additionally, the bladder 30 is inflatable to a variety of diameters to accommodate pools of varying diameters. The outer surface 38 of the bladder 30 recedes between each of the first 12 and second 26 disks when the bladder 30 is deflated.

A plurality of engaging members 42 is provided and each of the engaging members 42 is coupled to the bladder 30. Each of the engaging members 42 releasably engages the perimeter wall 33 of the pool 14 when the bladder 30 is inflated thereby retaining the bladder 30 in the pool 14. Each of the engaging members 42 is positioned on the outer surface 38 of the bladder 30 and he engaging members 42 are spaced apart from each other and are distributed around an entire circumference of the outer surface 38. Each of the engaging members 42 includes a leg 44 extending away from the outer surface 38 and a foot 46 extending downwardly from the leg 44 and being spaced from the outer surface 38. Thus, a space 48 is defined between the foot 46 of each of the engaging members 42 and the outer surface 38 of the bladder 30. Moreover, the perimeter wall 33 pool 14 is positioned in the space 48 in each of the engaging members 42 when the bladder 30 is inflated to retain the bladder 30 on the water 16.

An inflation unit 50 is coupled to the top disk 12 and the inflation unit 50 is in fluid communication with the bladder 30. The inflation unit 50 comprises a receptacle 52 that is positioned within the top disk 12. The receptacle 52 extends through each of the top surface 18 of the top disk 12, the bottom surface 20 of the top disk 12 and the top surface 18 of the bladder 30. Thus, the receptacle 52 is in fluid communication with an interior of the bladder 30. The receptacle 52 is actuatable into an open position to facilitate a gas to pass through the receptacle 52 and into the bladder 30 when the receptacle 52 is turned on. Additionally, the receptacle 52 is actuatable into a closed position to inhibit the gas to pass through the receptacle 52 when the receptacle 52 is turned off. The receptacle 52 is positioned on the housing 24 and the receptacle 52 includes an input 53 that is positioned within the housing 24. The receptacle 52 may be a CO2 cartridge adapter of any conventional design that is switchable between an open position and a closed position.

A switch 54 is slidably coupled to the top disk 12 and the switch 54 is coupled to the receptacle 52. The switch 54 turns the receptacle 52 on and off when the switch 54 is manipulated. The switch 54 may be an electrical switch and the receptacle 52 may be an electrically actuated valve. A power supply, such as a battery, may be positioned in the housing 24 and the power supply may be electrically coupled to the switch 54 and the receptacle 52. Alternatively, the switch 54 may be a mechanical switch and the receptacle 52 may be a mechanically actuated valve.

A cartridge 56 provided that is filled with a compressed gas, such as carbon dioxide or other inert gas. The cartridge 56 has an output 58 and the cartridge 56 may be a CO2 cartridge of any conventional design. The cartridge 56 is insertable into the receptacle 52 having the output 58 of the cartridge 56 being fluidly coupled to the input 53 of the receptacle 52. Thus, the compressed gas contained in the cartridge 56 enters the bladder 30 to inflate the bladder 30.

In use, the cartridge 56 is inserted into the receptacle 52 and each of the top disk 12 and the bottom disk 26 are placed in the pool 14. The switch 54 is manipulated to turn on the receptacle 52 and the cartridge 56 inflates the bladder 30. The bladder 30 is inflated until the outer surface 38 of the bladder 30 engages the inner surface of the perimeter wall 33 of the pool 14. Thus, the water 16 in the pool 14 is covered without requiring one or more individuals to manually position a traditional pool 14 cover over the water 16 in the pool 14. The cartridge 56 is removed from the receptacle 52 and the switch 54 is manipulated to deflate the bladder 30 thereby facilitating the bladder 30, the top disk 12 and the bottom disk 26 to be removed from the pool 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An inflatable pool cover assembly being configured to be selectively inflated to cover a pool, said assembly comprising:

a top disk being positionable in a pool wherein said top disk is configured to float on water in the pool, said top disk having a top surface and a bottom surface, said top surface having a prominence extending away from said bottom surface to define a housing on said top disk;

a bottom disk being positionable in the pool wherein said bottom disk is configured to float on water in the pool, said bottom disk having an upper surface;

a bladder being positioned between said top disk and said bottom disk, said bladder being inflatable to a selected diameter having said bladder engaging an inside surface of a perimeter wall of the pool wherein said bladder is configured to cover the water in the pool, said bladder having a top surface, a bottom surface and an outer surface extending therebetween, said outer surface being continuous such that said bladder has a circular shape, said bottom surface of said top disk being coupled to said top surface of said bladder, said top disk being centrally positioned on said top surface of said bladder, said upper surface of said bottom disk being coupled to said bottom surface of said bladder, said bottom disk being centrally positioned on said bottom surface of said bladder;

a plurality of engaging members, each of said engaging members being coupled to said bladder, each of said engaging members releasably engaging the perimeter wall of the pool when said bladder is inflated thereby retaining said bladder in the pool;

an inflation unit being coupled to said top disk, said inflation unit being in fluid communication with said bladder, said inflation unit comprising a receptacle being positioned within said top disk, said receptacle extending through each of said top surface of said top disk, said bottom surface of said top disk and said top surface of said bladder such that said receptacle is in fluid communication with an interior of said bladder, said receptacle being positioned on said housing, said receptacle being actuatable into an open position to facilitate a gas to pass through said receptacle and into said bladder when said receptacle is turned on, said receptacle being actuatable into a closed position to inhibit the gas to pass through said receptacle when said receptacle is turned off, said receptacle having an input being positioned within said housing;

a switch being slidably coupled to said top disk, said switch being coupled to said receptacle, said switch turning said receptacle on and off; and a cartridge being filled with a compressed gas, said cartridge being fluidly coupled to said inflation unit thereby facilitating said compressed gas to exit the cartridge and inflate said bladder.

2. The assembly according to claim 1, wherein said outer surface is spaced outwardly beyond a perimeter edge of each of said top disk and said bottom disk when said bladder is inflated such that said outer surface abuts the inside surface of the perimeter wall of the pool wherein said bladder is configured to accommodate pools of varying diameters.

3. The assembly according to claim 1, wherein each of said engaging members is positioned on said outer surface of said bladder, said engaging members being spaced apart from each other and being distributed around an entire circumference of said outer surface.

4. The assembly according to claim 3, wherein each of said engaging members includes a leg extending away from said outer surface and a foot extending downwardly from said leg and being spaced from said outer surface to define a space between said foot of each of said engaging members and said outer surface, said perimeter wall being positioned in said space in each of said engaging members.

5. The assembly according to claim 1, wherein said cartridge has an output, said cartridge being insertable into said receptacle having said output being fluidly coupled to said input.

6. An inflatable pool cover assembly being configured to be selectively inflated to cover a pool, said assembly comprising:

a top disk being positionable in a pool wherein said top disk is configured to float on water in the pool, said top disk having a top surface and a bottom surface, said top surface having a prominence extending away from said bottom surface to define a housing on said top disk;

a bottom disk being positionable in the pool wherein said bottom disk is configured to float on water in the pool, said bottom disk having an upper surface;

a bladder being positioned between said top disk and said bottom disk, said bladder being inflatable to a selected diameter having said bladder engaging an inside surface of a perimeter wall of the pool wherein said bladder is configured to cover the water in the pool, said bladder having a top surface, a bottom surface and an outer surface extending therebetween, said outer surface being continuous such that said bladder has a circular shape, said bottom surface of said top disk being coupled to said top surface of said bladder, said top disk being centrally positioned on said top surface of said bladder, said upper surface of said bottom disk being coupled to said bottom surface of said bladder, said bottom disk being centrally positioned on said bottom surface of said bladder, said outer surface being spaced outwardly beyond a perimeter edge of each of said top disk and said bottom disk when said bladder is inflated such that said outer surface abuts the inside surface of the perimeter wall of the pool wherein said bladder is configured to accommodate pools of varying diameters;

a plurality of engaging members, each of said engaging members being coupled to said bladder, each of said engaging members releasably engaging the perimeter wall of the pool when said bladder is inflated thereby retaining said bladder in the pool, each of said engaging members being positioned on said outer surface of said bladder, said engaging members being spaced apart from each other and being distributed around an entire circumference of said outer surface, each of said engaging members including a leg extending away from said outer surface and a foot extending downwardly from said leg and being spaced from said outer surface to define a space between said foot of each of said engaging members and said outer surface, said perimeter wall being positioned in said space in each of said engaging members; and an inflation unit being coupled to said top disk, said inflation unit being in fluid communication with said bladder, said inflation unit comprising:

a receptacle being positioned within said top disk, said receptacle extending through each of said top surface of said top disk, said bottom surface of said top disk and said top surface of said bladder such that said receptacle is in fluid communication with an interior of said bladder, said receptacle being positioned on said housing, said receptacle being actuatable into an open position to facilitate a gas to pass through said receptacle and into said bladder when said receptacle is turned on, said receptacle being actuatable into a closed position to inhibit the gas to pass through said receptacle when said receptacle is turned off, said receptacle having an input being positioned within said housing; and a switch being slidably coupled to said top disk, said switch being coupled to said receptacle, said switch turning said receptacle on and off; and a cartridge being filled with a compressed gas, said cartridge having an output, said cartridge being fluidly coupled to said inflation unit thereby facilitating said compressed gas to exit the cartridge and inflate said bladder, said cartridge being insertable into said receptacle having said output being fluidly coupled to said input.

* * * * *